US008227680B2

(12) United States Patent
Ishioka

(10) Patent No.: US 8,227,680 B2
(45) Date of Patent: Jul. 24, 2012

(54) BOOKLET PAGE TURNING APPARATUS, BOOKLET PAGE TURNING METHOD, AND BOOKLET PROCESSING APPARATUS

(75) Inventor: Yukinobu Ishioka, Utsunomiya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 127 days.

(21) Appl. No.: 12/885,085

(22) Filed: Sep. 17, 2010

(65) Prior Publication Data

US 2011/0061273 A1 Mar. 17, 2011

(30) Foreign Application Priority Data

Sep. 17, 2009 (JP) ..... 2009-216073

(51) Int. Cl.
*G10G 7/00* (2006.01)

(52) U.S. Cl. ..... 84/486; 84/487; 84/488; 84/489; 84/490; 84/491; 84/492; 84/493; 84/494; 84/495; 84/496; 84/497; 84/498; 84/499; 84/500; 84/501; 84/502; 84/503; 84/504; 84/505; 84/506; 84/507; 84/508; 84/509; 84/510; 84/511; 84/512; 84/513; 84/514; 84/515; 84/516; 84/517; 84/518; 84/519; 84/520

(58) Field of Classification Search ..... 84/486–520; 400/25

See application file for complete search history.

(56) References Cited

U.S. PATENT DOCUMENTS

| | | | | |
|---|---|---|---|---|
| 4,516,866 | A * | 5/1985 | Yamauchi et al. | 400/25 |
| 5,156,465 | A * | 10/1992 | Kakiuchi | 400/56 |
| 5,183,347 | A * | 2/1993 | Higuchi et al. | 400/583.3 |
| 5,233,900 | A * | 8/1993 | Fitzgerald | 84/497 |
| 5,267,799 | A * | 12/1993 | Nukada | 400/26 |
| 7,547,152 | B2 * | 6/2009 | Sapir-Haim | 400/28 |
| 7,714,221 | B2 * | 5/2010 | Ishioka | 84/519 |
| 2009/0266224 | A1 * | 10/2009 | Ishioka | 84/486 |
| 2010/0247216 | A1 * | 9/2010 | Ishioka | 400/582 |
| 2010/0328695 | A1 * | 12/2010 | Kanda et al. | 358/1.12 |
| 2011/0061273 | A1 * | 3/2011 | Ishioka | 40/531 |
| 2012/0055755 | A1 * | 3/2012 | Ishioka | 198/380 |

FOREIGN PATENT DOCUMENTS

JP 2005-144756 6/2005

* cited by examiner

*Primary Examiner* — Elvin G Enad
*Assistant Examiner* — Robert W Horn
(74) *Attorney, Agent, or Firm* — Pillsbury Winthrop Shaw Pittman, LLP

(57) ABSTRACT

According to one embodiment, a booklet page turning apparatus includes a guide member which is provided near a vacuum pad to freely project/retreat from a plane corresponding to the suction surface of the vacuum pad, the guide member moving integrally with the vacuum pad and coming into contact with a page of a booklet at the page turning position to regulate rising of the page.

20 Claims, 20 Drawing Sheets

BOOKLET PAGE TURNING APPARATUS, BOOKLET PAGE TURNING METHOD, AND BOOKLET PROCESSING APPARATUS

CROSS-REFERENCE TO RELATED APPLICATIONS

This application is based upon and claims the benefit of priority from Japanese Patent Application No. 2009-216073, filed Sep. 17, 2009; the entire contents of which are incorporated herein by reference.

FIELD

Embodiments described herein relate generally to a booklet page turning apparatus for turning the pages of a booklet, a booklet page turning method, and a booklet processing apparatus.

BACKGROUND

As a method of separating stacked sheets one by one from above and carrying them, a negative pressure suction scheme using vacuum pads is known well.

This scheme does not depend on the rigidity of a medium, and is therefore usable in a page turning apparatus for a booklet having a plurality of high rigidity pages.

The vacuum pads themselves are also rich in variety to cope with the properties of media. Some vacuum pads have the rotation axis of swinging motion to permit rotation about the center of gravity upon lifting a medium. Some vacuum pads can deform by themselves (by using a rubber material or having a bellows structure).

A page turning apparatus using vacuum pads is one of processing units of a booklet printer. The booklet printer is formed by connecting a plurality of processing units via feed paths. A booklet is subjected to predetermined processing in each processing unit, and then fed to the processing unit connected next.

The booklet is fed to a page turning position to turn pages. A feed guide is provided on the page turning position so as to regulate rising of a page due to the booklet's inclination to close and ensure satisfactory feed.

However, when the feed guide is provided, it needs to retreat to prevent interference during the page turning operation. In addition, since mechanisms for realizing page turning are densely arranged near the page turning position so as to make the structure complex, the mechanism for causing the feed guide to retreat also becomes complex.

An apparatus capable of regulating rising of a booklet page without needing a complex mechanism is desired.

DETAILED DESCRIPTION

In general, according to one embodiment, a booklet page turning apparatus includes a guide member which is provided near a vacuum pad to freely project/retreat from a plane corresponding to the suction surface of the vacuum pad, the guide member moving integrally with the vacuum pad and coming into contact with a page of a booklet at the page turning position to regulate rising of the page.

The embodiment will now be described with reference to the accompanying drawing.

Figure 24:
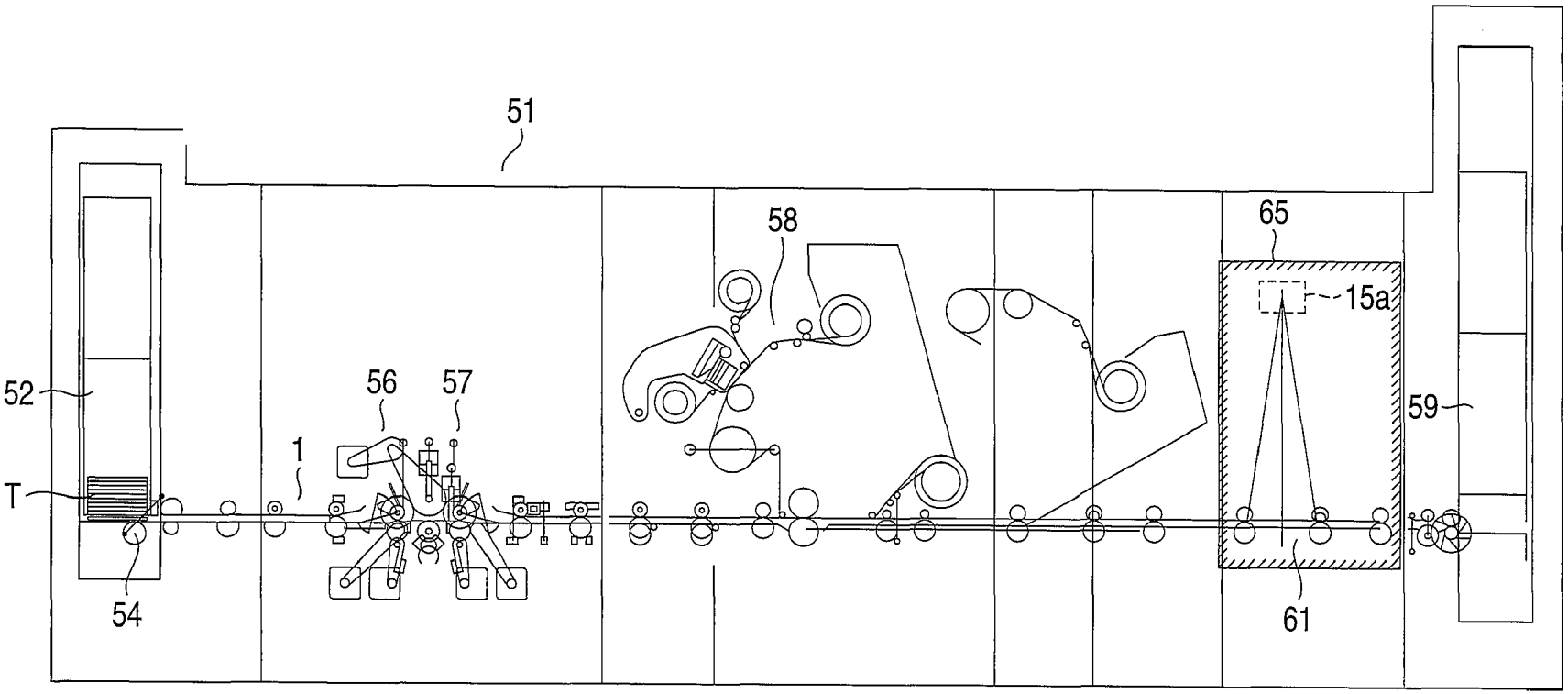
FIG. 24 is a schematic view showing a booklet processing apparatus including the booklet page turning apparatus in FIG. 1.

FIG. 24 is a schematic view showing a booklet processing apparatus according to the embodiment.

The booklet processing apparatus has an apparatus main body 51. A booklet supply unit 52 is provided on one side in the apparatus main body 51. A plurality of closed booklets T are stored in the booklet supply unit 52 in a stacked state. Each booklet T in the booklet supply unit 52 is extracted from the lower portion by an extraction roller 54 serving as a supply device for supplying the booklets one by one, and fed along a feed path 1.

An OCR unit 56 that reads unique information of the booklet. T, a page turning apparatus 57 that turns a specific page of the booklet T, and a printing unit 58 serving as a printing device are disposed in the feed path 1 sequentially along the booklet feed direction. A collection unit 59 that collects the output booklets T is provided at the output end of the feed path 1.

The printing unit 58 operates based on print information input from an external terminal (not shown) to the control processing unit.

A carriage 61 is provided in the feed path 1 between the printing unit 58 and the collection unit 59 described above. The carriage 61 receives the open booklet T fed from the printing unit 58, and then moves along a moving path (not shown) perpendicular to the feed path 1. A booklet folding unit (not shown) and an inspection unit 65 are disposed in the moving path sequentially along the moving direction (depth direction) of the carriage 61.

The inspection unit 65 including a camera 15*a* causes the camera 15*a* to capture the printed surface of the booklet T fed by the carriage 61, and collates the captured contents with the contents input from the external terminal, thereby inspecting whether printing has been done correctly.

Figure 1:
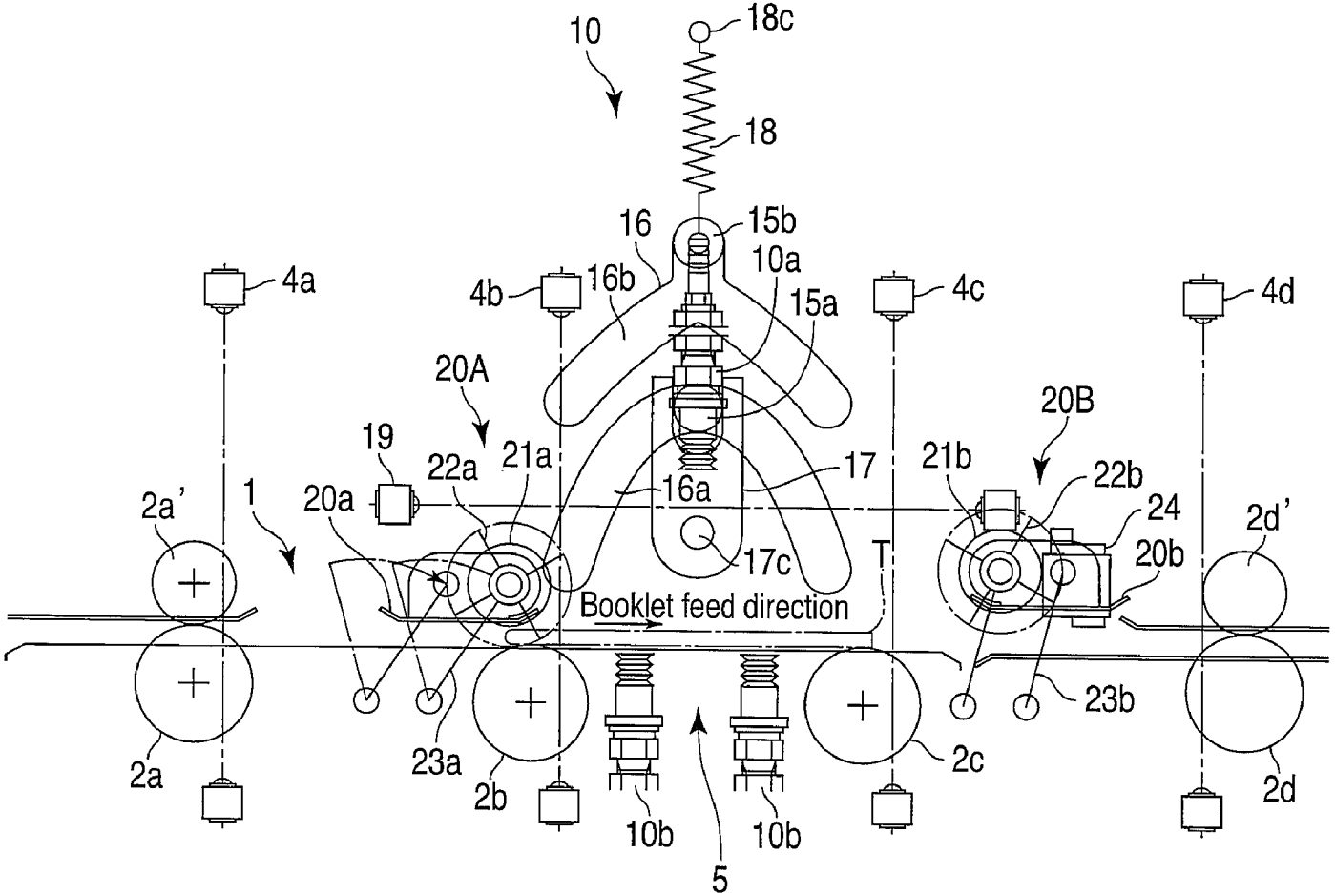
FIG. 1 is a view showing a booklet page turning apparatus according to an embodiment.

FIG. 1 is a view showing the above-described booklet page turning apparatus 57.

The feed path 1 includes a plurality of feed rollers 2*a* to 2*d* serving as a feed device and detection sensors 4*a* to 4*d* which optically detect the booklet T, all of which are disposed at predetermined intervals along the feed direction of the booklet T.

Pinch rollers 2*a*' and 2*d*' are in rolling contact with the upper portions of the feed rollers 2*a* and 2*d*, respectively. The feed rollers 2*b* and 2*c* are arranged at a page turning position 5. A feed roller driving motor 26 shown in FIG. 5 rotatably drives the feed rollers 2*a* to 2*d*.

Figure 5:
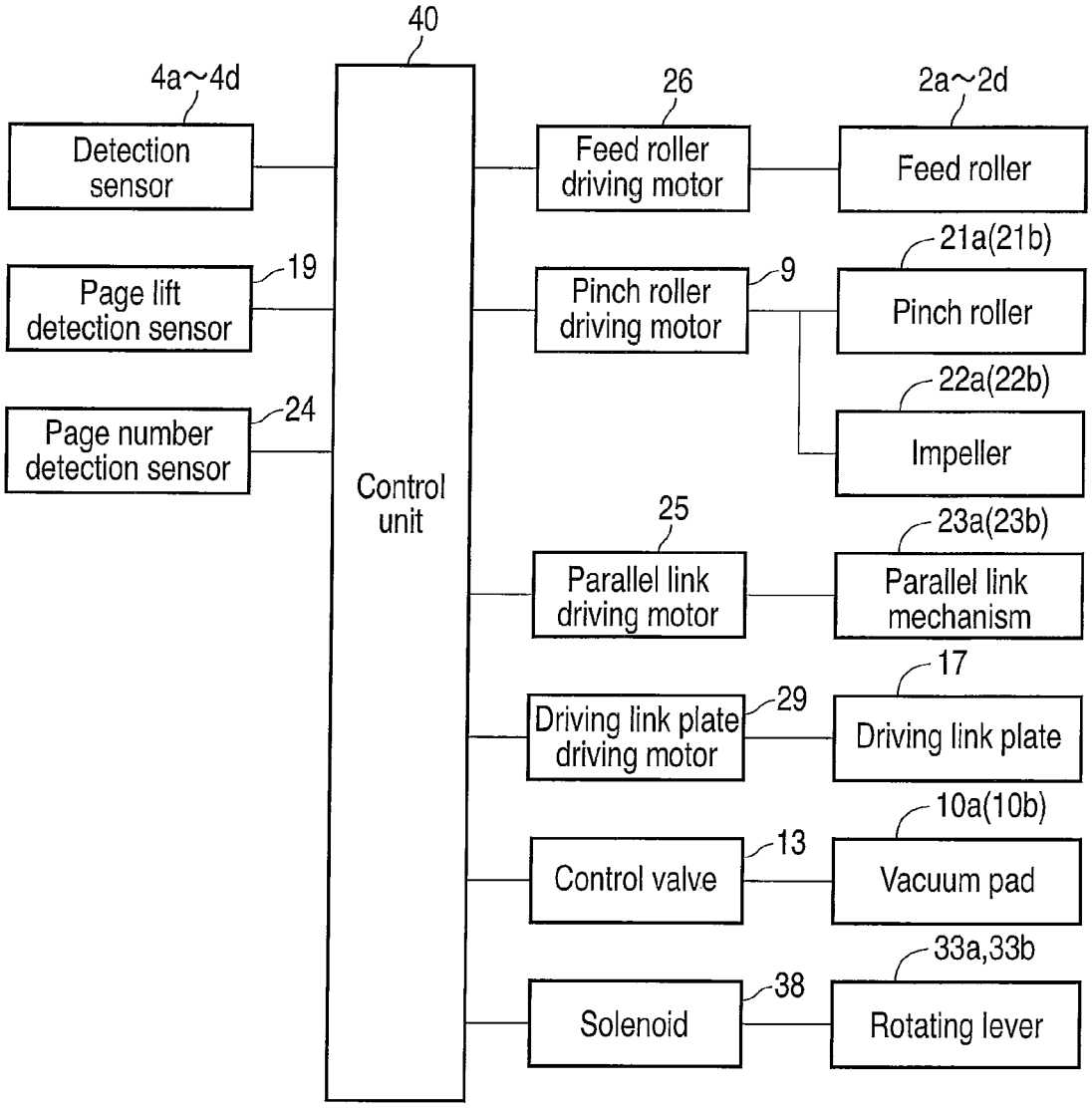
FIG. 5 is a block diagram showing the driving control system of the page turning apparatus in FIG. 1.

Contact feed mechanisms 20A and 20B are disposed above the feed rollers 2*b* and 2*c*, respectively. A page lift detection sensor 19 which optically detects a page sucked and lifted by vacuum pads 10*a* to be described later is provided above the page turning position 5. A page number detection sensor 24 which detects the page number of a turned page is provided near the contact feed mechanism 20B. The above-described detection sensors 4*a* and 4*d*, page lift detection sensor 19, and page number detection sensor 24 are connected to a control unit 40 serving as a control device via signal circuits, as shown in FIG. 5.

Figure 2:
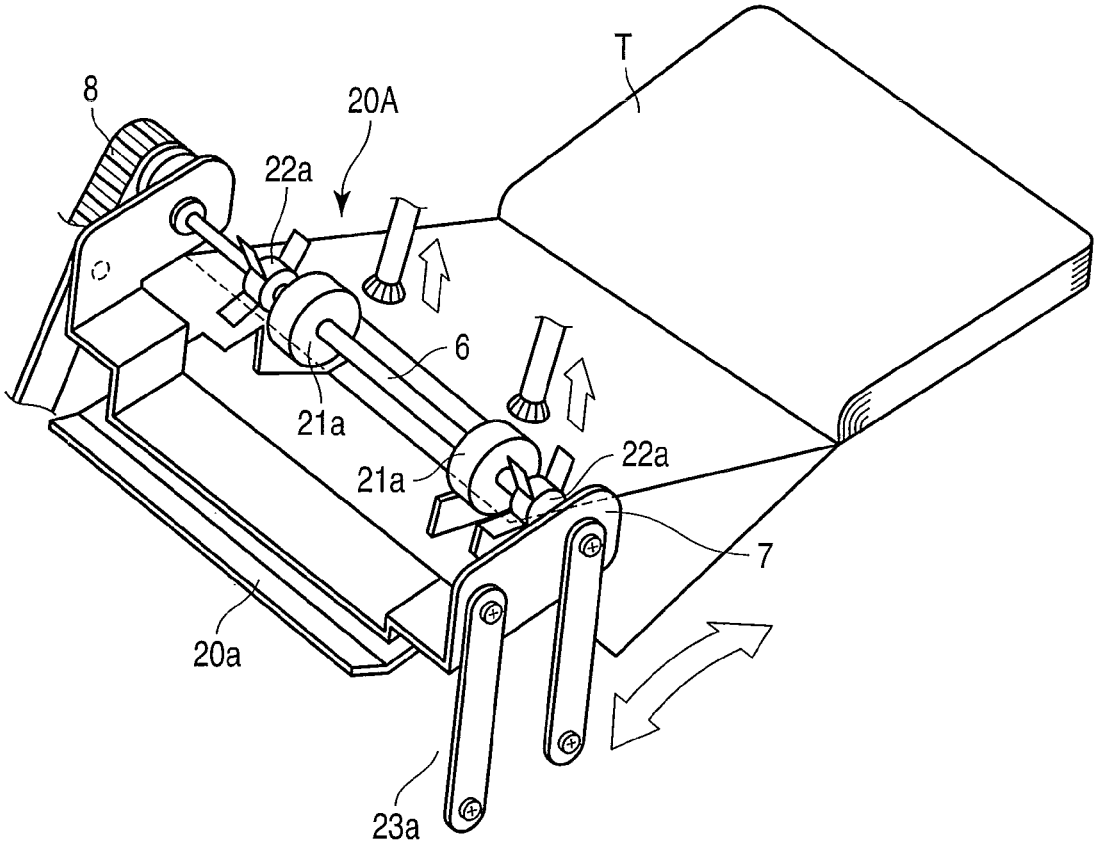
FIG. 2 is a perspective view showing the pinch rollers and impellers of the page turning apparatus in FIG. 1 and a driving system therefor.

The contact feed mechanism 20A comprises pinch rollers 21*a* serving as a second contact roller unit. The pinch rollers 21*a* are attached to a shaft 6, as shown in FIG. 2. Impellers 22*a* are also attached to the shaft 6 near the pinch rollers 21*a*. Each impeller 22*a* has a plurality of flexible beating plates disposed radially on the circumferential surface. When rotating, the impellers 22*a* bring the beating plates into contact with the booklet T to beat down the pages under the page to be turned.

FIG. 2 illustrates the driving system of the pinch rollers 21*a* and the impellers 22*a*.

A support bracket 7 rotatably supports the shaft 6. One end of the shaft 6 projects outward from the support bracket 7. The projecting portion of the shaft 6 is connected to a pinch roller driving motor (shown in FIG. 5) 9 via a driving belt 8. When the pinch roller driving motor 9 is driven, the pinch rollers 21*a* and the impellers 22*a* rotate in the forward and backward directions.

A guide member 20*a* configured to guide feed of the booklet T is integrally attached to the support bracket 7. The support bracket 7 is supported by a parallel link mechanism 23*a*. A parallel link driving motor (shown in FIG. 5) 25 rotates the parallel link mechanism 23*a* in the forward and backward directions. As the parallel link mechanism 23*a* rotates, the guide member 20*a* moves, together with the pinch rollers 21*a* and the impellers 22*a*, between the feed position in the vicinity of the feed roller 2*b* and the retreat position off to the upper left of the feed position.

Note that the contact feed mechanism 20B has the same structure as the above-described contact feed mechanism 20A. More specifically, the contact feed mechanism 20B comprises a guide member 20*b*, pinch rollers (first contact roller unit) 21*b*, impellers 22*b*, and parallel link mechanism 23*b*. The contact feed mechanism 20B moves the guide member 20*b*, pinch rollers 21*b*, and impellers 22*b* between the feed position in the vicinity of the feed roller 2*c* and the standby position off to the upper right of the feed position.

A turning suction mechanism 10 is provided at the above-described page turning position 5.

Figure 3:
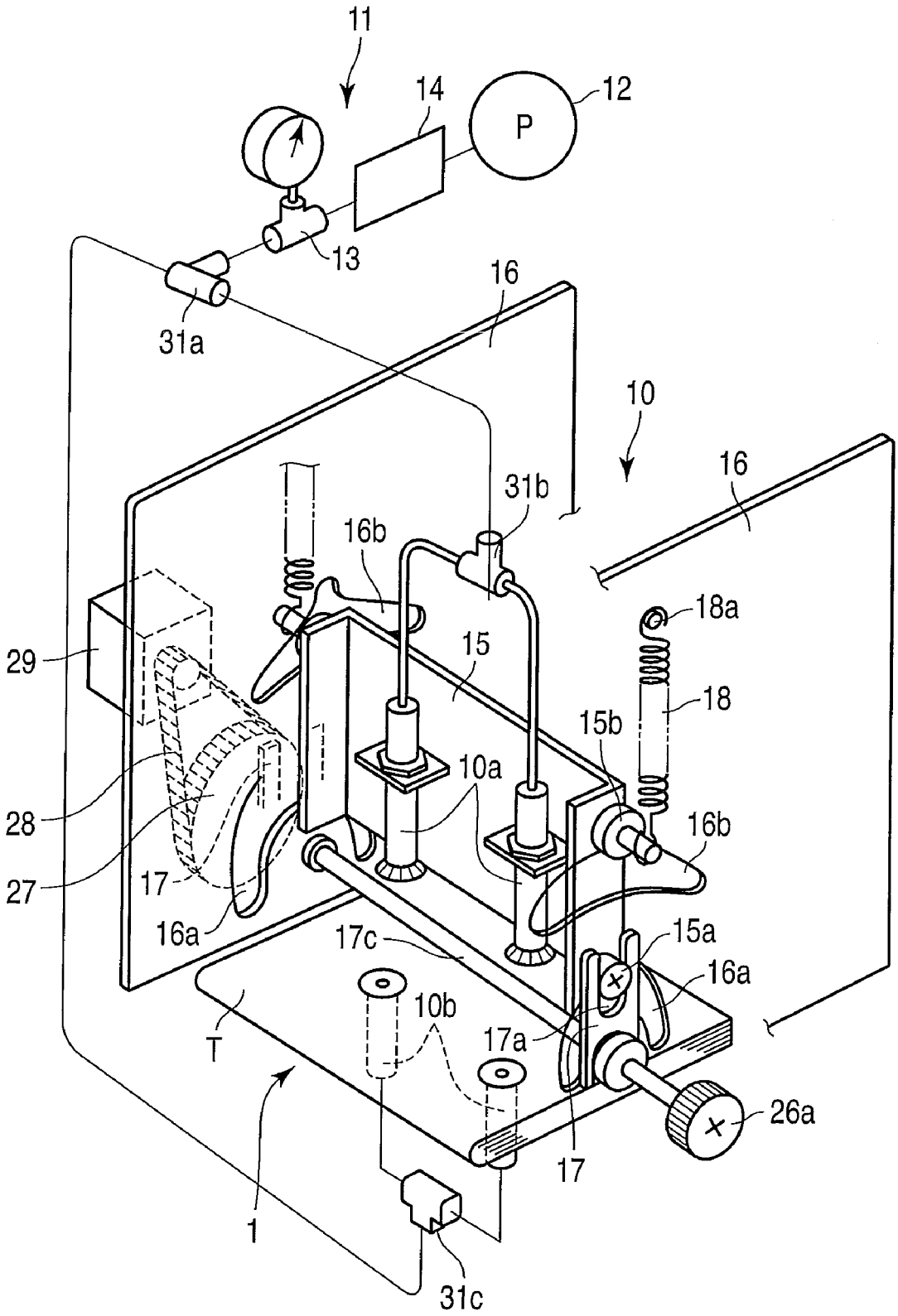
FIG. 3 is a perspective view showing the vacuum pads of the page turning apparatus in FIG. 1 and a driving system therefor.

The turning suction mechanism 10 will be explained below with reference to FIG. 3.

The turning suction mechanism 10 comprises upper and lower vacuum pads 10*a* and 10*b* which are arranged on the upper and lower sides of the feed path 1. The lower vacuum pads 10*b* are attached with the suction ports being up so as to oppose the lower surface of the booklet T fed right above. The upper vacuum pads 10*a* are attached to a support carriage 15. A pump 12 is connected to the vacuum pads 10*a* and 10*b* via a negative pressure supply circuit 11. The negative pressure supply circuit 11 comprises a filter 14 which separates dust from air sucked by a negative pressure, a control valve 13 which switches the negative pressure, and branch pipes 31*a* to 31*c*.

When the control valve 13 is opened, a negative pressure is generated in the vacuum pads 10*a* and 10*b*, and the vacuum pads 10*a* and 10*b* suck the booklet T facing them. A suction force W [N] of the vacuum pads 10*a* and 10*b* is given by $$W=0.1\times P\times A/S$$

P: vacuum pressure (gauge pressure) [−kPa]

A: vacuum pad area [$cm^2$]

S: safety factor

Guide rings 15*a* and 15*b* are provided on the lower and upper sides of the two side portions of the support carriage 15. Guide plates 16 are disposed on both sides of the support carriage 15 so as to face each other. The guide rings 15*a* and 15*b* of the support carriage 15 fit in cam grooves 16*a* and 16*b* of the guide plates 16.

The lower guide rings 15*a* also fit in groove portions 17*a* of driving link plates 17 serving as a driving device. The driving link plates 17 are connected to a driving shaft 17*c*. The driving shaft 17*c* spans between the guide plates 16. A hand knob 26*a* is attached to one end of the driving shaft 17*c*. A driving link plate driving motor 29 is connected to the other end via a driving pulley 27 and a driving belt 28.

The shafts of the upper guide rings 15*b* are connected to hook portions 18*a* of the guide plates 16 via springs 18 to elastically bias the support carriage 15 upward.

When the driving link plate driving motor 29 is driven, the driving shaft 17*c* is rotated via the driving belt 28 and the driving pulley 27, and the driving link plates 17 rotate in the forward and backward directions (horizontal direction). Along with the rotation, the guide rings 15*a* and 15*b* are guided along the two cam grooves 16*a* and 16*b* of each guide plate 16 so as to move the support carriage 15.

Note that in the initial state before the support carriage 15 moves, the driving link plates 17 stand at 12 o'clock, and the vacuum pads 10*a* supported by the support carriage 15 are at the upper retreat position.

Figure 4:
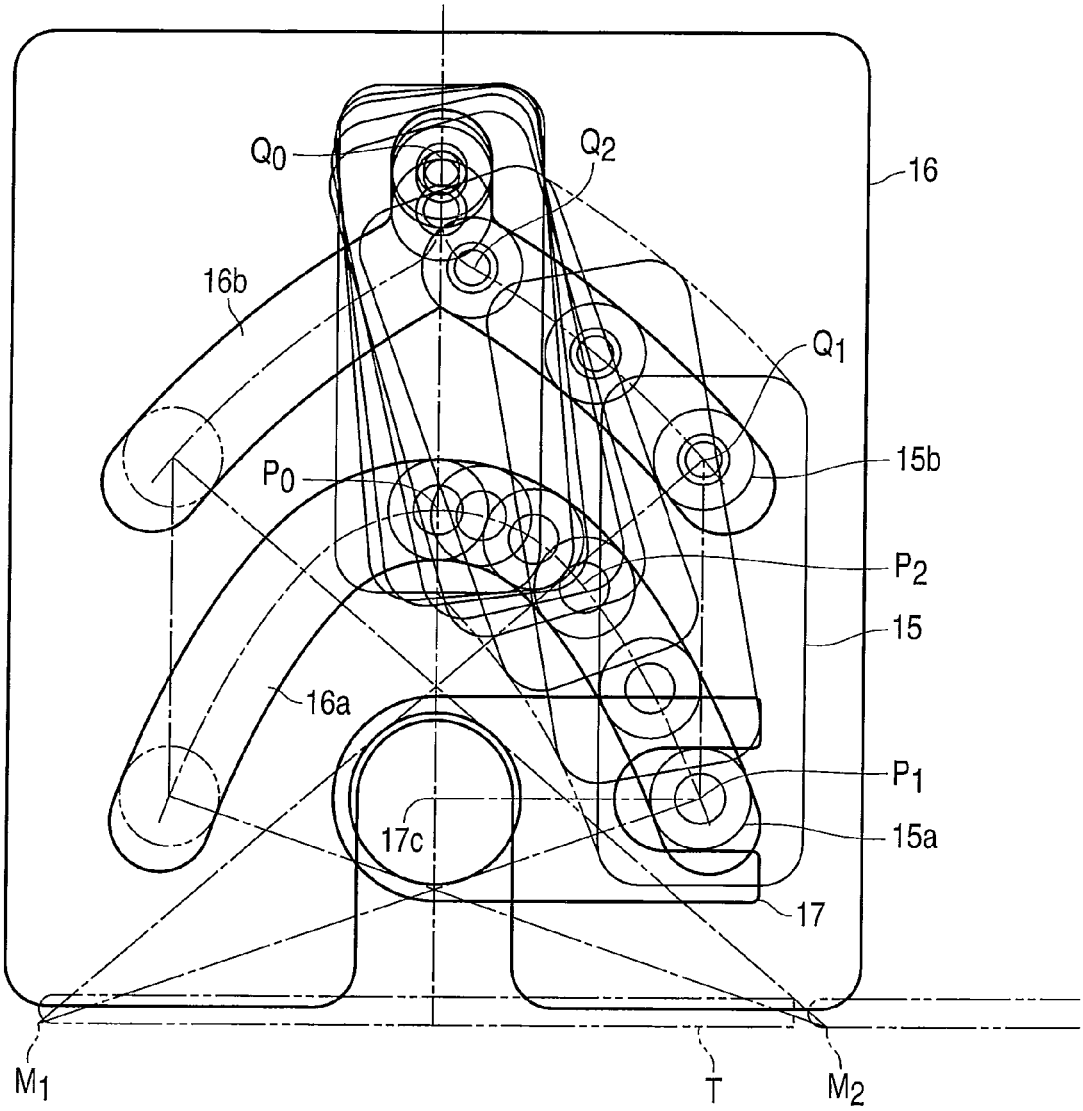
FIG. 4 is a view showing the moving locus of the vacuum pads in FIG. 3.

FIG. 4 shows the page turning position 5 of the booklet T and the locus of the support carriage 15 of the pads which moves along the cam grooves 16*a* and 16*b* of the guide plates 16.

$M_1$ indicates the binding position of the booklet T at the page turning start position; $M_2$, the binding position of the booklet T at the reverse page turning start position; $P_n$, the central position of the guide ring 15*a*; and $Q_n$, the central position of the guide ring 15*b*.

The position and orientation of the support carriage 15 are decided by two points corresponding to the central positions $P_n$ and $Q_n$ of the guide rings 15*a* and 15*b*. The vacuum pads 10*a* move together with the support carriage 15. More specifically, since the cam grooves 16*a* and 16*b* of each guide plate 16 draw arcs with $M_1$ at the center between $P_1$ and $P_2$ and between $Q_1$ and $Q_2$, respectively, the vacuum pads 10*a* move in synchronism with a lifting operation about $M_1$ using the binding portion of the uppermost page of the booklet T at the center of rotation.

In reverse page turning, the shapes of the cam grooves 16*a* and 16*b* of the guide plates 16 and the movement of the vacuum pads 10*a* about $M_2$ are symmetrical to those described above.

The section between $P_0$ and $P_2$ is formed by an arc that smoothly connects curves formed by symmetrically extending the curve between $P_1$ and $P_2$. However, the section between $Q_0$ and $Q_2$ is formed to linearly retreat in the direction of the axis of symmetry of the cam groove 16*b* of the guide plate 16.

Hence, the support carriage 15 decreases its tilt angle, and when the central positions of the guide rings 15*a* and 15*b* reach $P_0$ and $Q_0$, returns to the upright state to locate the vacuum pads 10*a* at the upper retreat position (initial position).

At this time, the driving link plates 17 which move the guide rings 15*a* about the driving shaft (center of rotation) 17*c* stand at 12 o'clock, and can rotate clockwise and counterclockwise to move the support carriage 15 symmetrically. Since the maximum retreat position of the vacuum pads 10*a* in the page turning operation matches the turning start position of the reverse page turning operation, page turning and reverse page turning can be performed in a compact range.

Note that the binding position of the actual booklet T may sometimes shift from the position $M_1$ or $M_2$ because of the thickness of the booklet T, the manner the booklet T is bound, a high rigidity page arranged in the booklet T, or variations in the page turning start position caused by the feed operation. In the operation of lifting the uppermost page of the booklet T, the locus of the vacuum pads 10*a* is not ideal but shifted. However, this poses no serious problem because the lift angle is smaller than 45°, and a play allows to balance between the booklet T and the vacuum pads 10*a* and 10*b*. The play is ensured by elastic deformation of the vacuum pads 10*a* and 10*b* and elastic deformation of the booklet T near the binding portion.

FIG. 5 is a block diagram showing the driving control system of the above-described page turning apparatus.

As described above, the detection sensors 4*a* to 4*d*, page lift detection sensor 19, and page number detection sensor 24 are connected to the control unit 40 serving as a control device via signal circuits. The driving motors 9, 25, 26, and 29 for the above-described pinch rollers, parallel links, feed rollers, and driving link plates, the control valve 13, and a solenoid 38 to be described later are connected to the control unit 40 via control circuits so that the driving of the pinch rollers 21*a* and 21*b*, impellers 22*a* and 22*b*, parallel link mechanisms 23*a* and 23*b*, feed rollers 2*a* to 2*d*, driving link plates 17, vacuum pads 10*a* and 10*b*, and rotating levers 33*a* and 33*b* to be described later is controlled based on detection signals.

The page turning operation of the booklet T will be described next with reference to FIGS. 6, 7, 8, 9, 10, 11, 12, 13, 14, and 15.

Figure 6:
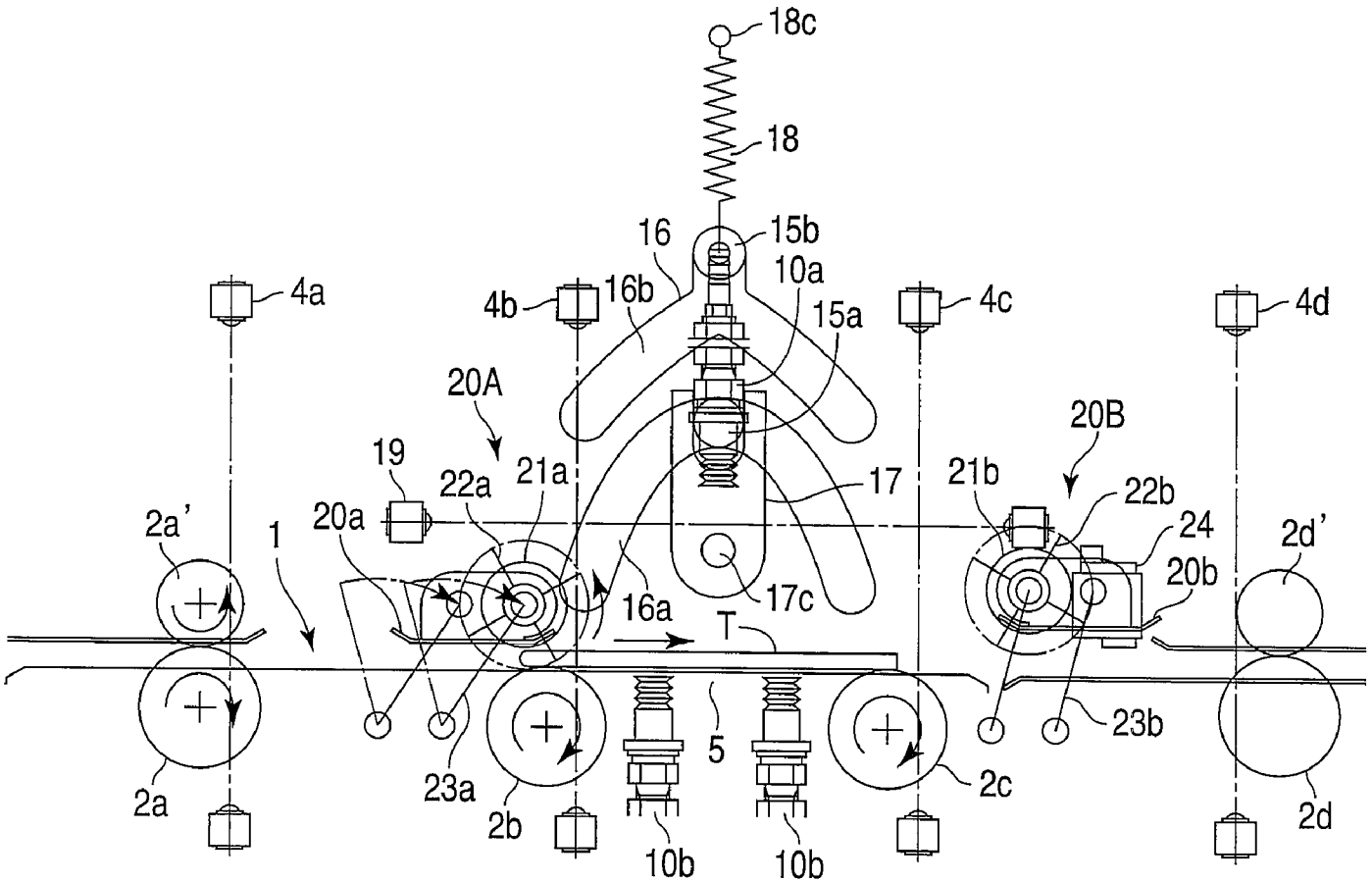
FIG. 6 is a view showing a state in which a booklet is fed to the page turning position in the page turning apparatus in FIG. 1.
Figure 7:
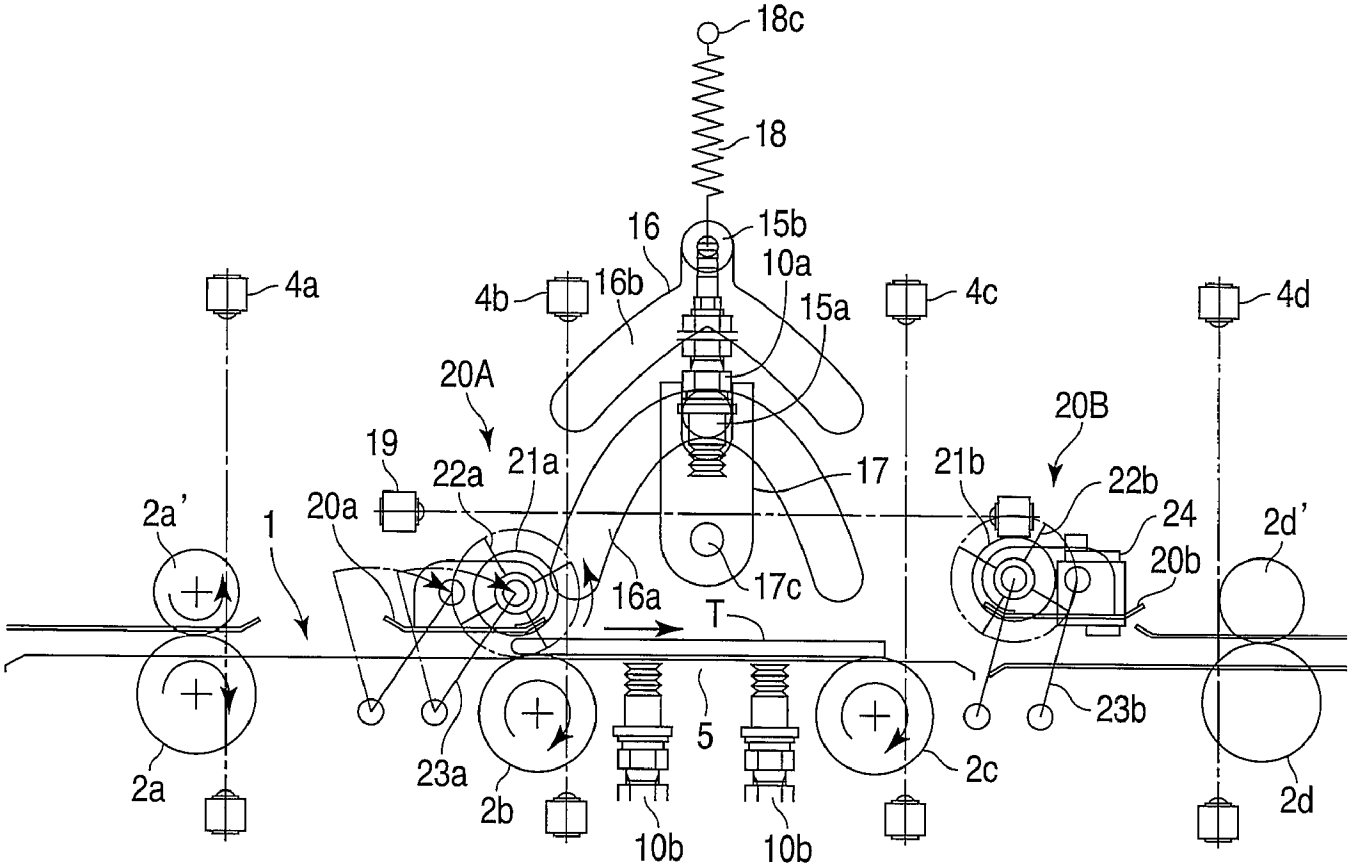
FIG. 7 is a view showing a state in which the vacuum pads lift the uppermost page of the booklet fed to the turning position in FIG. 6.

As the feed roller 2*a* rotates in the direction of the arrow, the booklet T is fed to the right side along the feed path 1. Upon this feed, when the booklet T is fed up to the detection sensor 4*b* and detected, the control unit 40 rotates the pinch rollers 21*a* and the impellers 22*a* in the direction of the arrow and also operates the parallel link mechanism 23*a*. When the parallel link mechanism 23*a* operates, the movable guide 20*a* moves from the retreat position to the feed position together with the pinch rollers 21*a* and the impellers 22*a*, as shown in FIG. 6. The feed roller 2*b* and the pinch rollers 21*a* sandwich the booklet T, and further feed it to the right side. Upon this feed, when the detection sensor 4*c* detects the leading edge of the booklet T, the feed roller 2*b* and the pinch rollers 21*a* rotate backward by a predetermined number of pulses. The booklet T is fed backward and stopped at the page turning position 5. After that, the parallel link mechanism 23*a* rotates counterclockwise so that the movable guide 20*a* moves and retreats upward from the feed position together with the pinch rollers 21*a* and the impellers 22*a*, as shown in FIG. 7.

Meanwhile, the control valve 13 is operated to generate a negative pressure in the vacuum pads 10*a* and 10*b* so that the lower vacuum pads 10*b* suck and hold the lower surface of the booklet T. At this time, the driving link plate driving motor 29 is operated to rotate the driving arm plates 17 clockwise so that the upper vacuum pads 10*a* come into contact with an uppermost page Ta of the booklet T and suck it, as shown in FIG. 7. After suction, the driving arm plates 17 rotate in the reverse direction (counterclockwise) and move upward along the locus of the cam grooves 16*a* of the guide plates 16 while the vacuum pads 10*a* keep sucking the uppermost page Ta.

With this operation, the uppermost page Ta of the booklet T is lifted using a binding portion Tb of the booklet T as the center of rotation without changing the suction state to the vacuum pads 10*a*. The uppermost page Ta of the booklet T is lifted about the binding portion Tb of the booklet T without receiving any bending deformation force at all. Hence, the rigidity of the page does not influence the turning operation.

Figure 8:
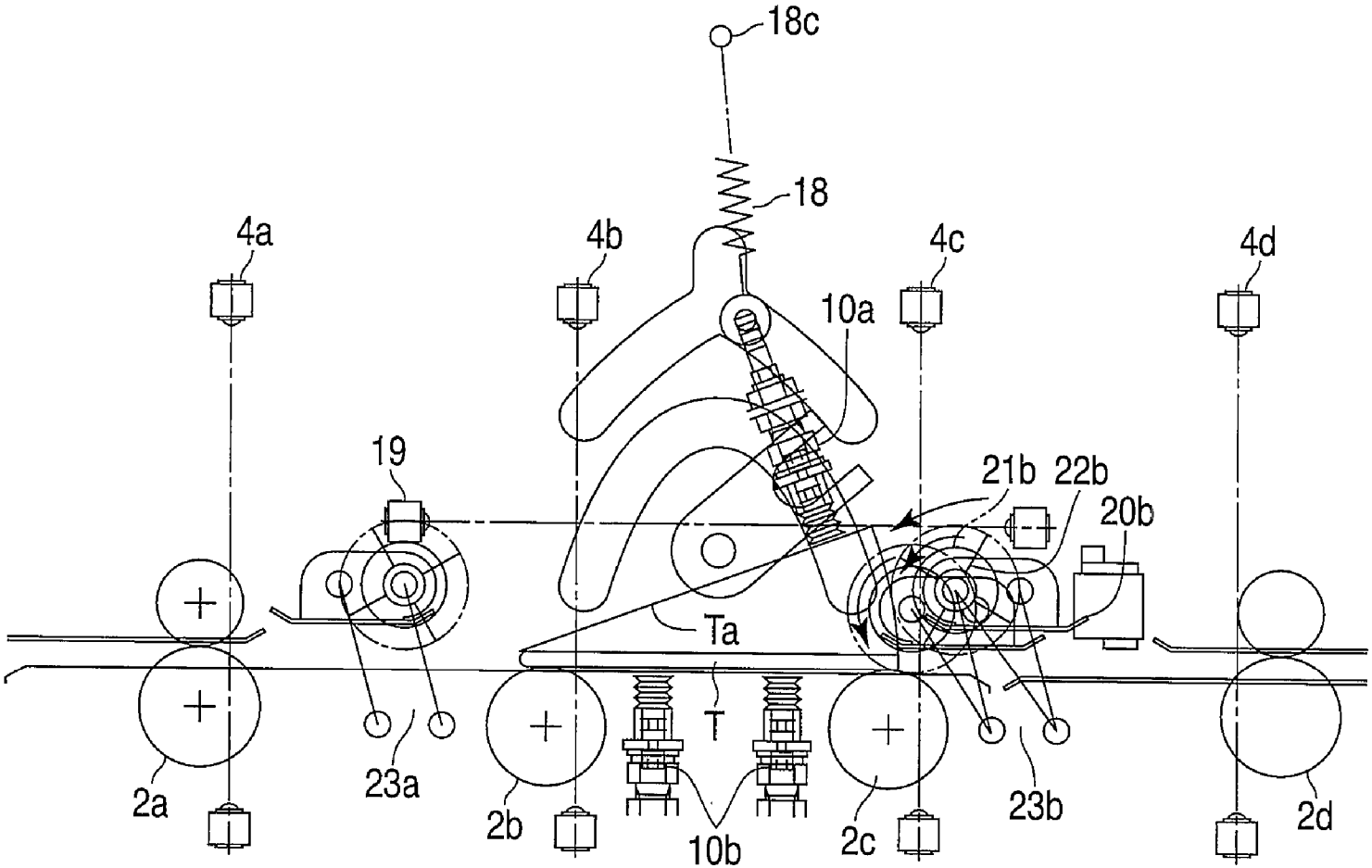
FIG. 8 is a view showing a state in which the pinch rollers enter under the uppermost page lifted by the vacuum pads in FIG. 7.

When the uppermost page Ta of the booklet T moves upward up to a predetermined position, the page lift detection sensor 19 detects it. Based on the detection, the control unit 40 moves the movable guide 20*b* from the retreat position to the feed position together with the rotating pinch rollers 21*b* and impellers 22*b*, as shown in FIG. 8. At this time, a plurality of pages under the uppermost page Ta of the booklet T, which rise as the uppermost page is lifted, are beaten down by the beating plates of the impellers 22*b*. The pinch rollers 21*b* enter to the lower surface side of the uppermost page Ta.

Figure 9:
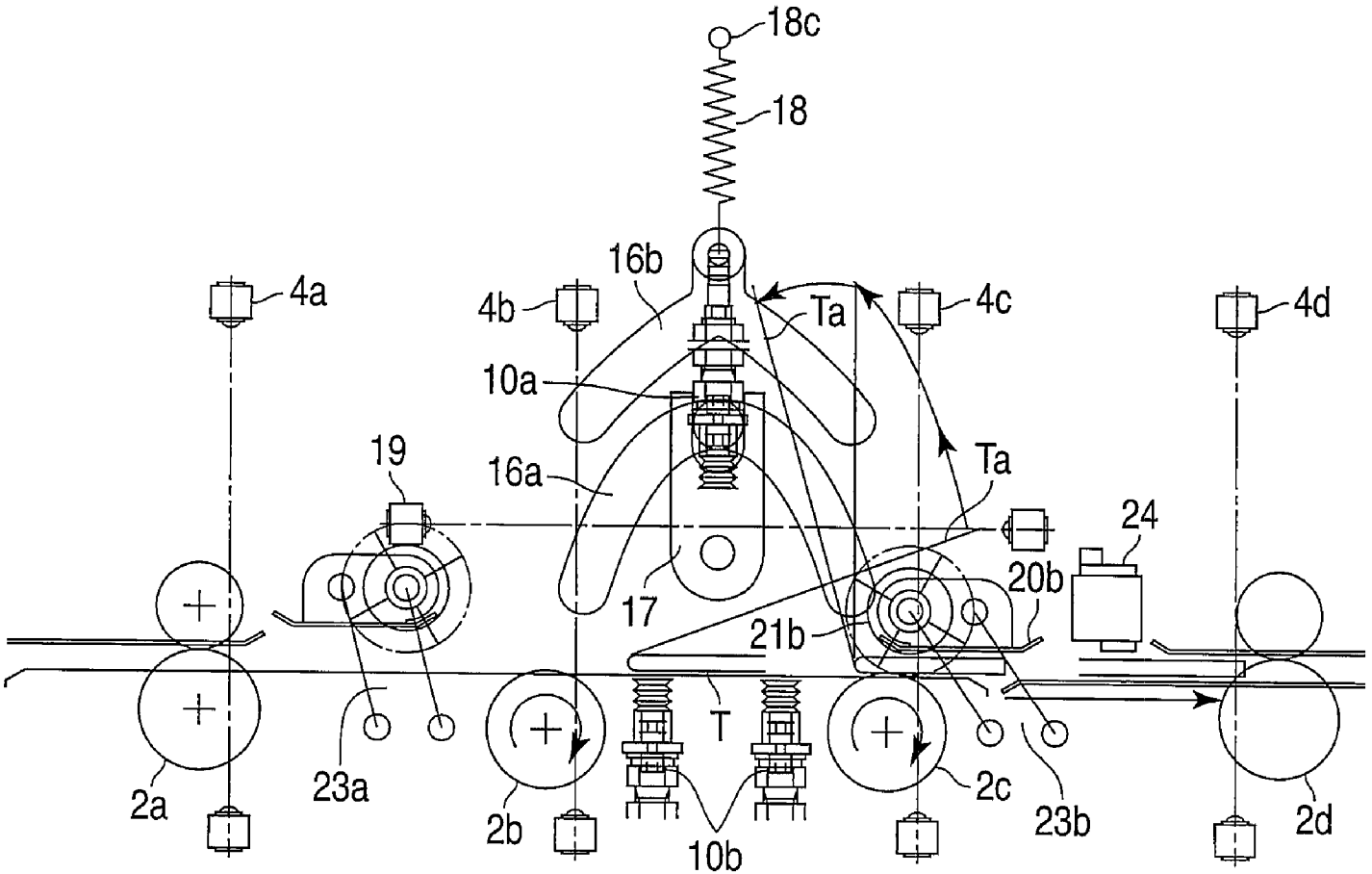
FIG. 9 is a view showing a state in which the booklet is fed from the state in which the pinch rollers have entered under the uppermost page in FIG. 8.

After that, the control unit 40 closes the control valve 13 and stops suction of the vacuum pads 10*a*. Next, the driving link plates 17 return to 12 o'clock in the initial state, and the vacuum pads 10*a* return to the upper retreat position, as shown in FIG. 9. After that, the feed roller 2*c* and the pinch rollers 21*b* rotate and feed the booklet T to the right side while sandwiching it. The booklet T is detected by the booklet detection sensor 4*d* and thus stops. This brings the uppermost page Ta of the booklet T into contact with the pinch rollers 21*b*.

Figure 10:
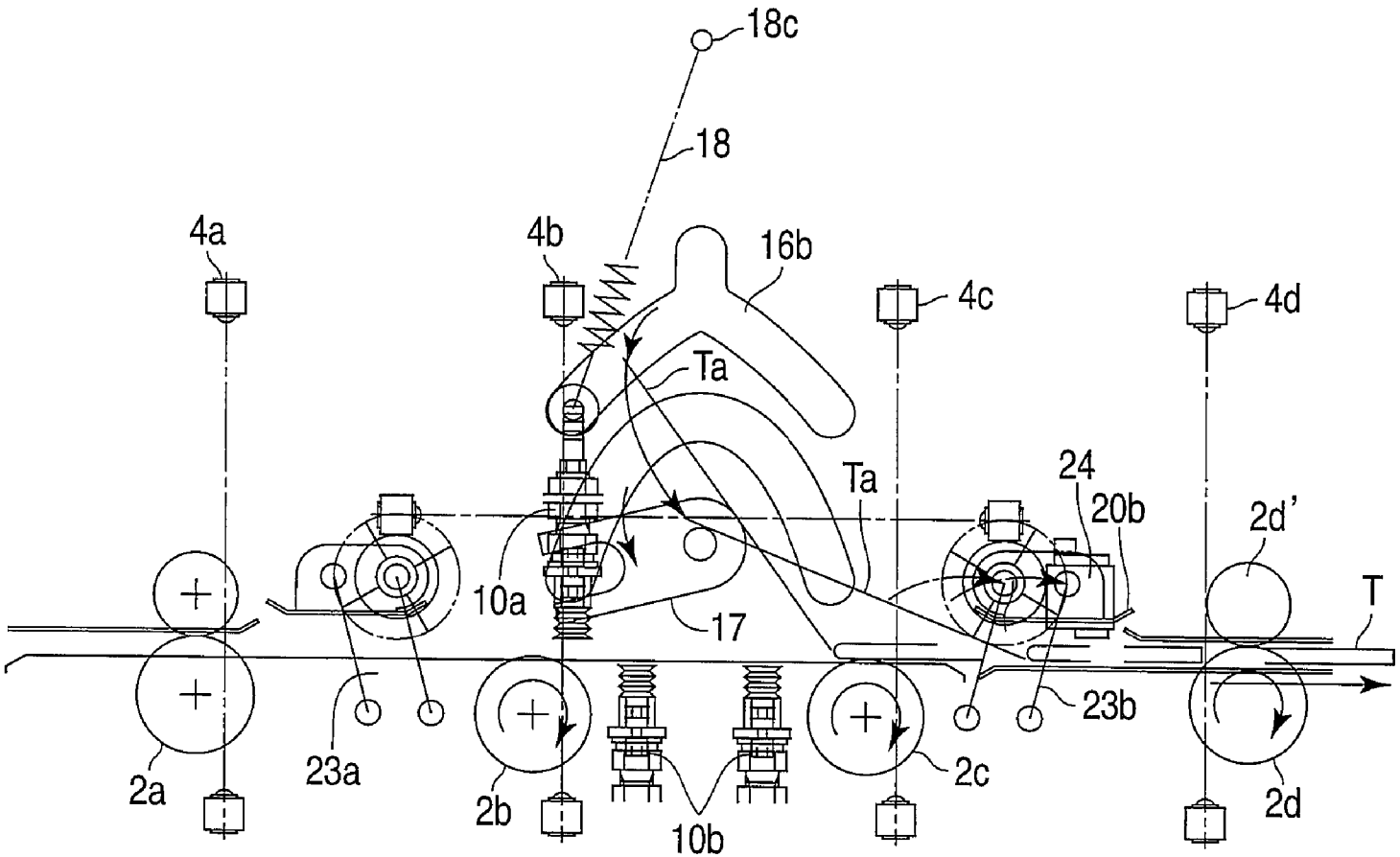
FIG. 10 is a view showing a state in which the uppermost page in contact with the pinch rollers is turned over as the booklet in FIG. 9 is fed.
Figure 11:
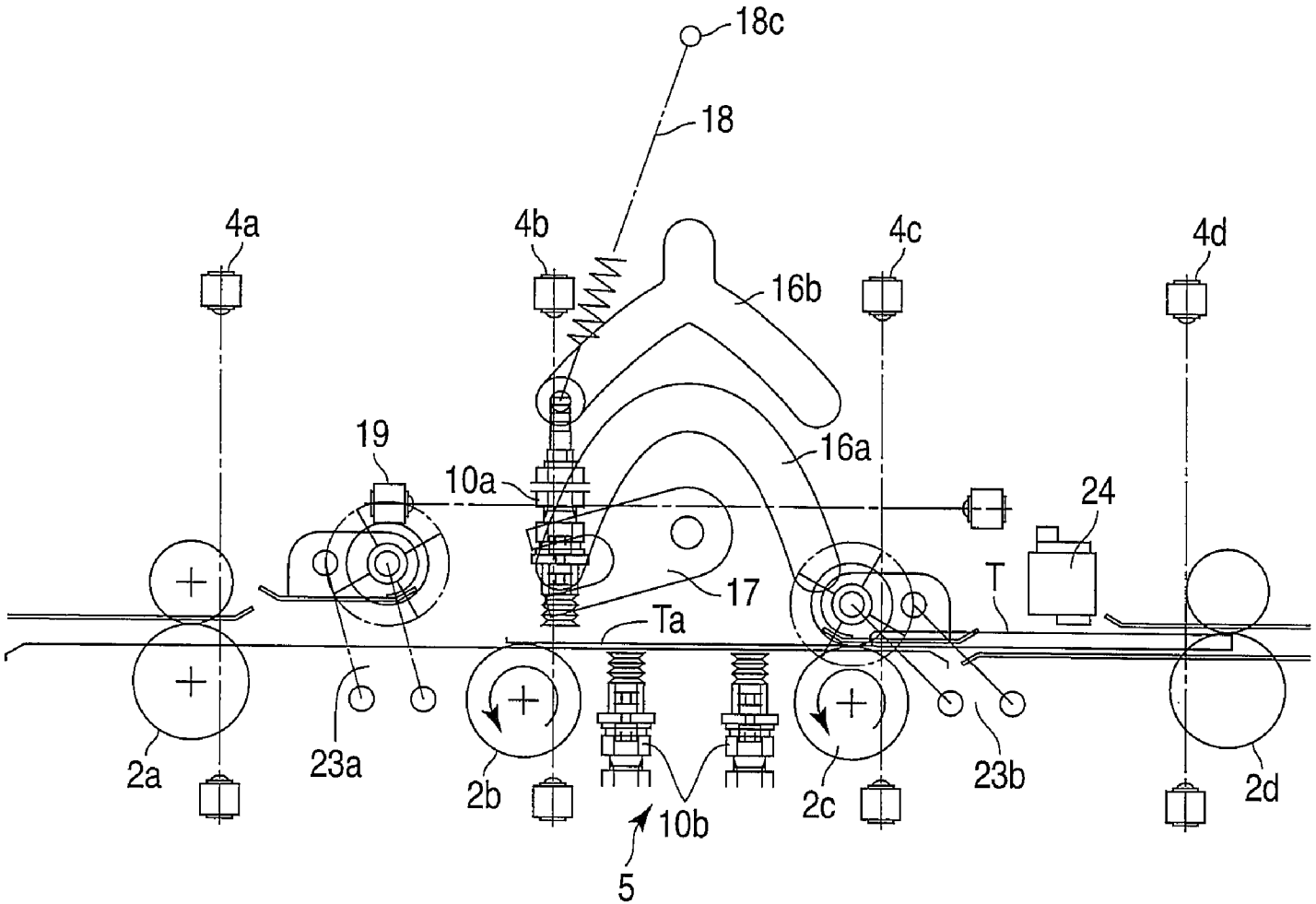
FIG. 11 is a view showing a state in which the uppermost page in FIG. 10 is completely turned over.

At this time, the driving link plates 17 rotate counterclockwise from the retreat state to move the vacuum pads 10*a* so that they retreat from the turnover operation range of the uppermost page Ta of the booklet T, as shown in FIG. 10. At this time, the right edge of the booklet T is already sandwiched between the feed roller 2*d* and the pinch rollers 2*d*' and set in a feedable state. The movable guide 20*b* returns to the retreat position. In this state, the feed roller 2*d* rotates to completely turn over the uppermost page Ta of the booklet T, as shown in FIG. 11, in a state in which no components to interfere exist in the neighborhood. In this case as well, the operation can be completed without depending on the rigidity of the page at all.

Note that during the feed, the page number detection sensor 24 scans the page number printed on the opened page Ta of the booklet T. The scan information is sent to the control unit 40. The control unit 40 determines based on the received scan information whether the turning operation has been performed as programmed. Upon determining that the turning operation has not been performed as programmed, the turning operation is redone.

Figure 12:
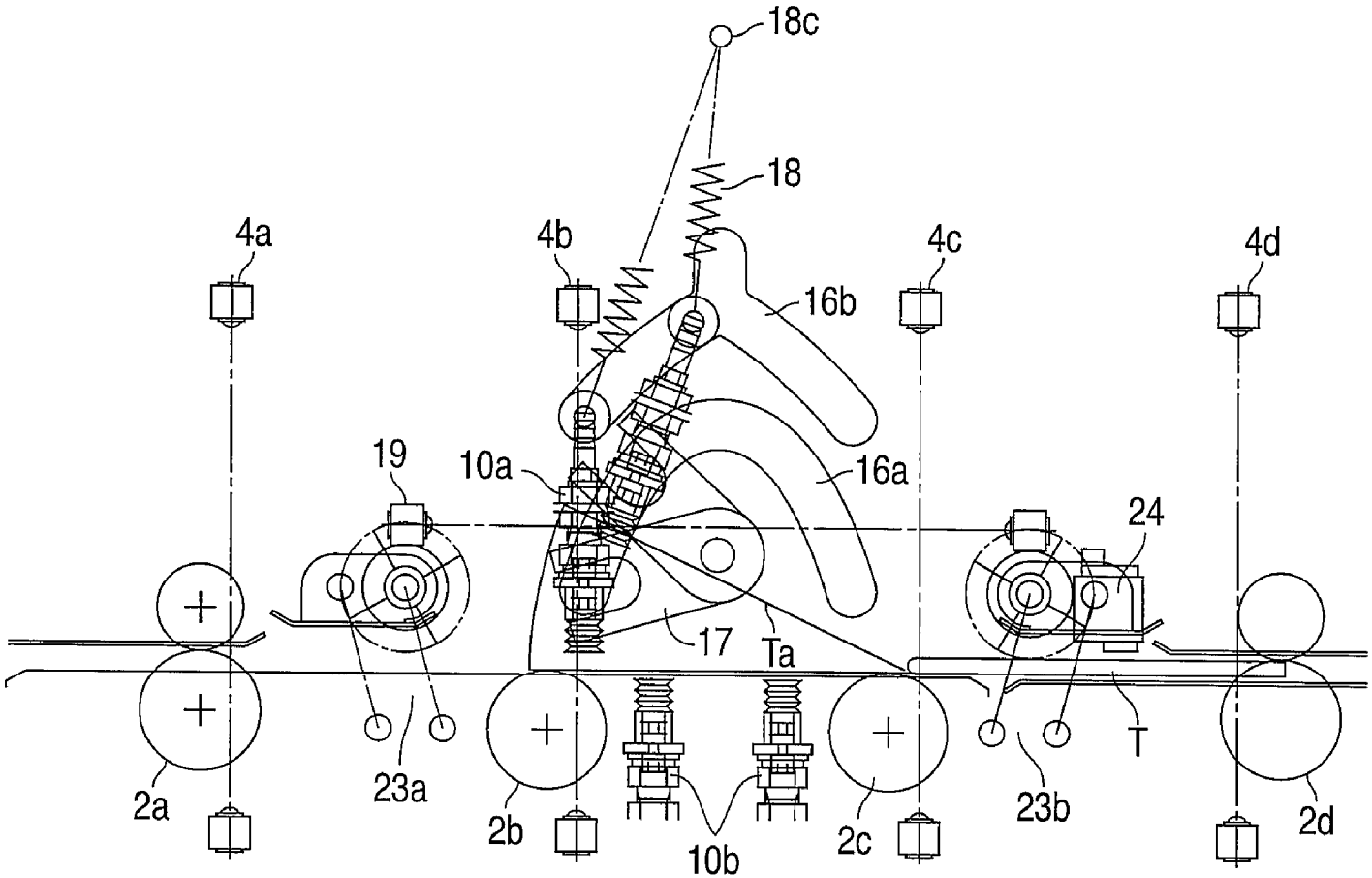
FIG. 12 is a view showing a state in which the uppermost page completely turned over in FIG. 11 is lifted by the vacuum pads in a reverse turning direction.
Figure 13:
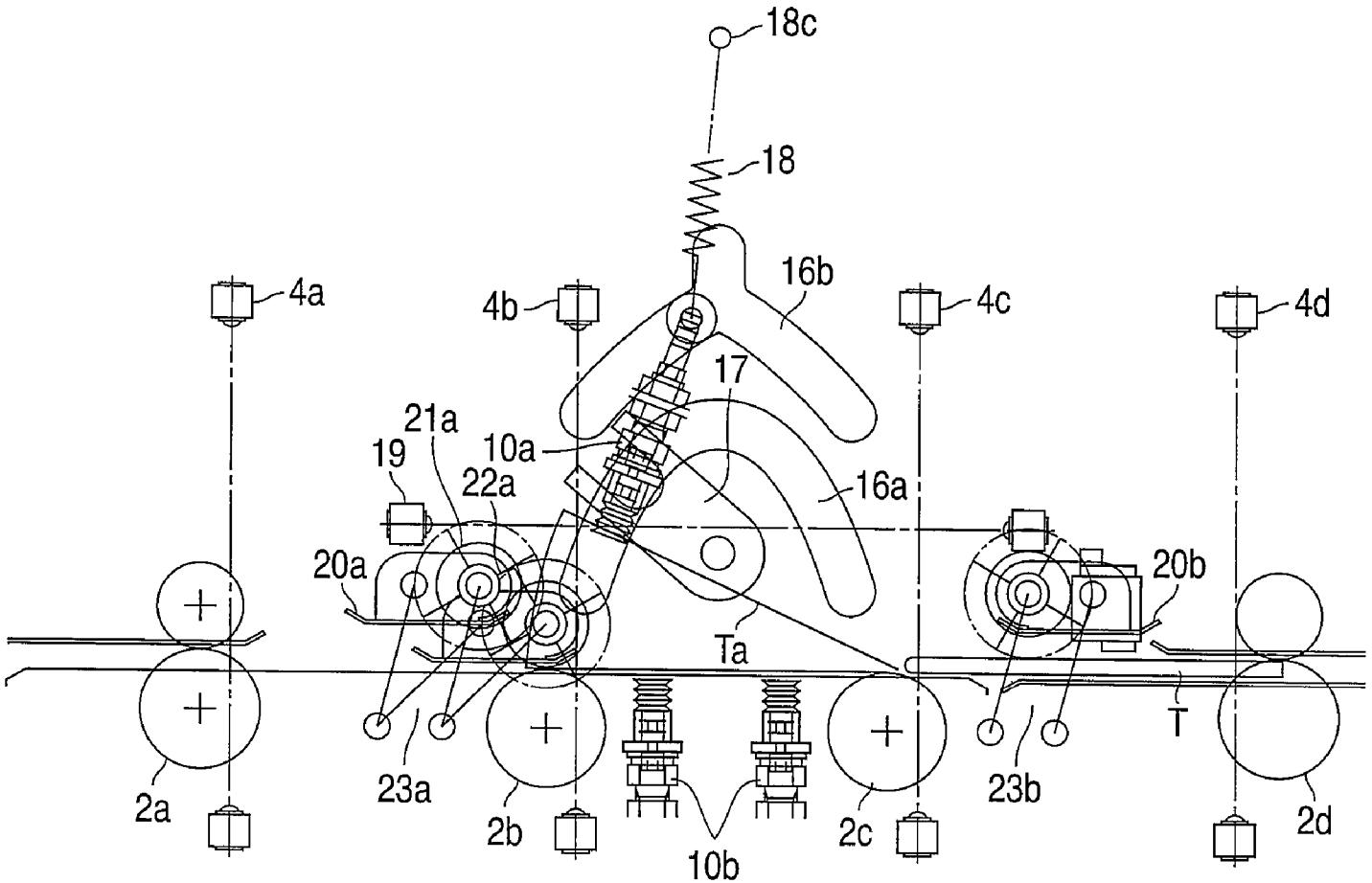
FIG. 13 is a view showing a state in which the pinch rollers enter under the uppermost page lifted in FIG. 12.
Figure 14:
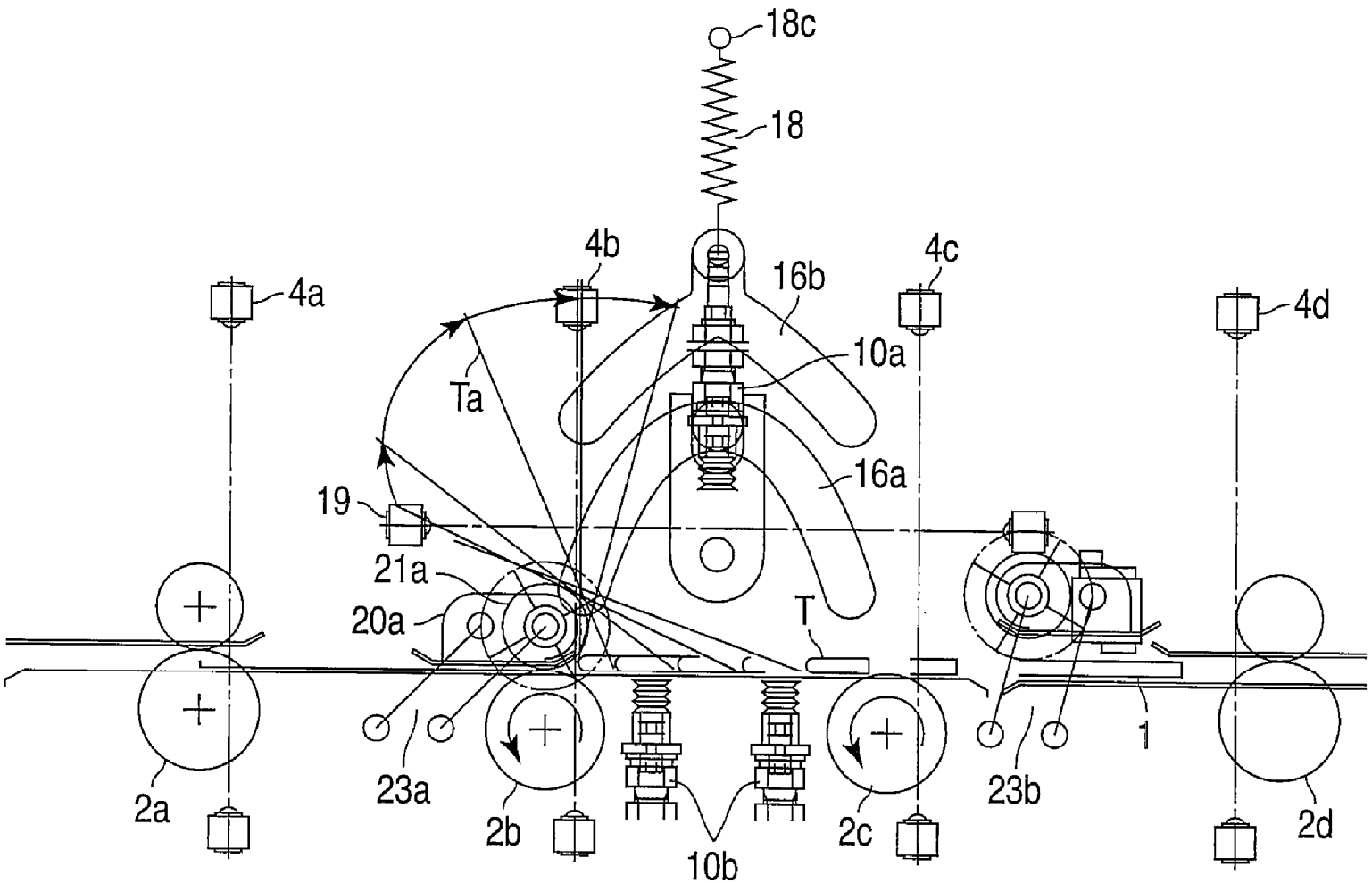
FIG. 14 is a view showing a state in which the uppermost page comes into contact with the pinch rollers that have entered under the uppermost page in FIG. 13.
Figure 15:
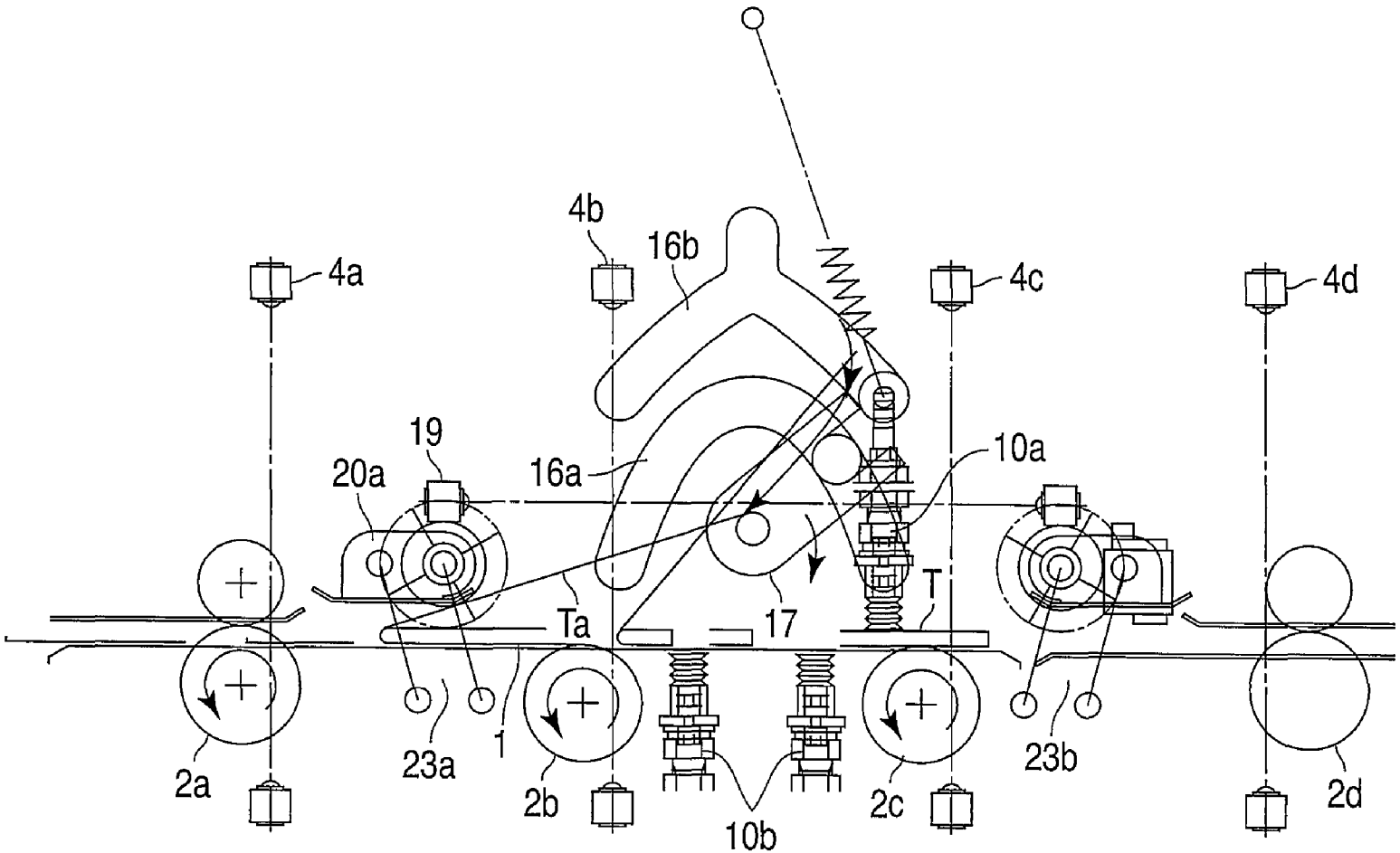
FIG. 15 is a view showing a state in which the uppermost page in contact with the pinch rollers in FIG. 14 largely rotates in the reverse turning direction.

Upon determining that the turning operation has been performed as programmed, the booklet T is fed to the post process and processed. After the process, the booklet T is fed backward and returned to the page turning position 5, as shown in FIG. 11. In this state, the vacuum pads 10*a* suck and lift the page Ta, as shown in FIG. 12. When the page lift detection sensor 19 detects the lifted page Ta, the movable guide 20*a* moves to the right side together with the pinch rollers 21*a* and the impellers 22*a* and enter to the lower surface side of the page Ta, as shown in FIG. 13. Then, as shown in FIG. 14, the feed rollers 2*b*, 2*c*, and 2*d* rotate in the directions of the arrows to feed the booklet T to the left side so that the page Ta comes into contact with the pinch rollers 21*a* and rotates in the closing direction. As the booklet T is further fed to the left side, as shown in FIG. 15, the page Ta rotates in the closing direction and closes, thus ending the page closing operation. During the page closing operation, the vacuum pads 10*a* retreat from the standby position to the lower right side not to come into contact with the page Ta that largely rotates in the closing direction.

If the control unit determines that the page number scanned and read by the page number detection sensor 24 is not correct, and the page turning operation is redone, as described above, or when the booklet T is transferred and fed to another unit on the upstream or downstream side of the page turning position 5, a raised page may deform as it come into contact with pinch rollers or the like arranged in the feed direction due to the inclination of the booklet T to close or open.

Figure 16:
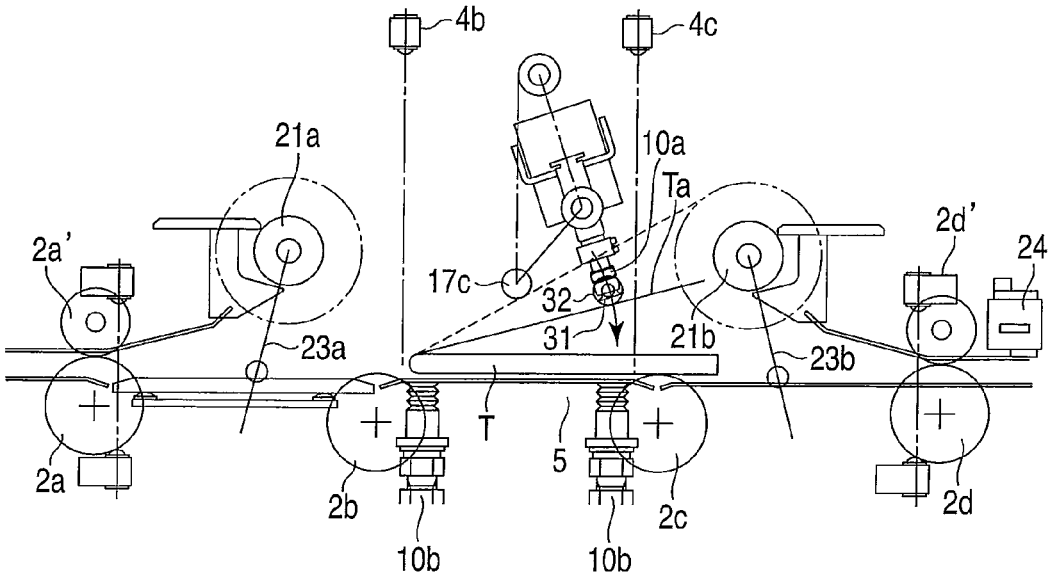
FIG. 16 is a view showing the vacuum pads of the page turning apparatus in FIG. 1 and a guide roller that is moved together with the vacuum pads.
Figure 17:
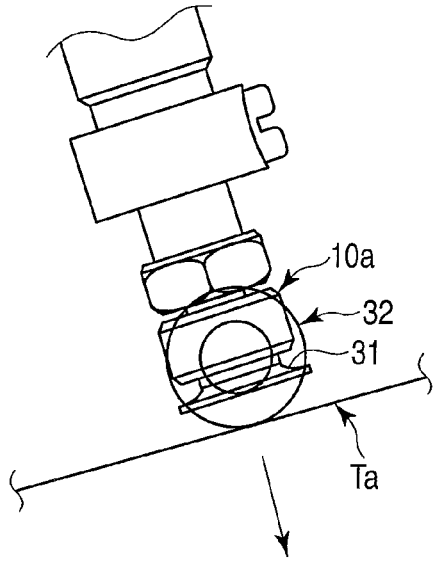
FIG. 17 is a view showing a state in which the guide roller in FIG. 16 pushes a page that rises due to the booklet's inclination to open.

In this embodiment, rising of the page Ta due to the inclination of the booklet T to close or open is suppressed using guide rollers 32 serving as guide members which move together with the vacuum pads 10*a*, as shown in FIGS. 16 and 17.

Figure 18:
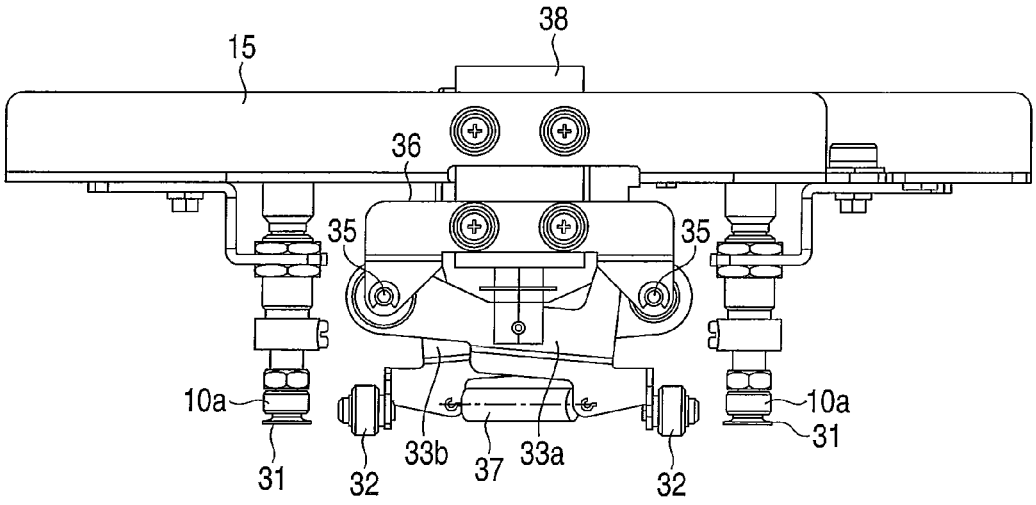
FIG. 18 is a view showing the attachment structure of the guide rollers in FIG. 16.
Figure 19:
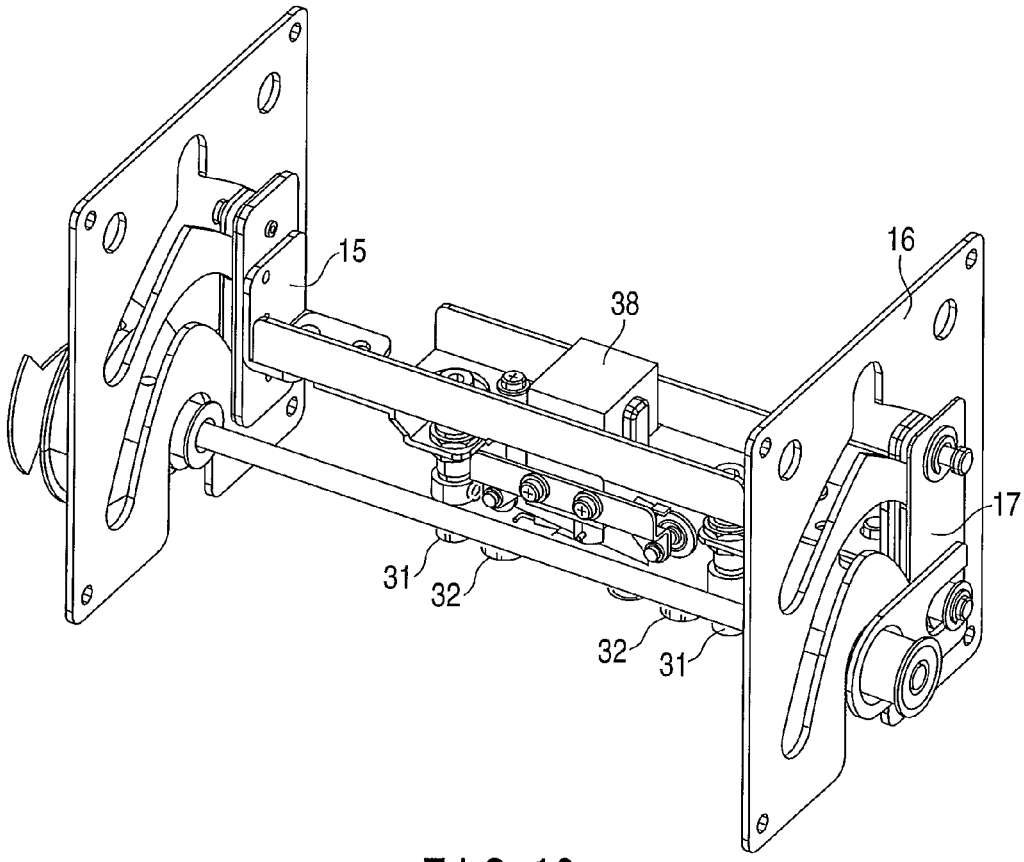
FIG. 19 is a perspective view showing the attachment structure of the guide rollers in FIG. 16.

As shown in FIGS. 18 and 19, the guide rollers 32 are disposed in the vicinity of the inner sides of suckers 31 of the pair of vacuum pads 10*a*.

The guide rollers 32 are attached to the support carriage 15 via an attachment bracket 36 and the first and second rotating levers 33*a* and 33*b* that form a link mechanism 33. More specifically, the guide rollers 32 are rotatably provided on the lower end sides of the first and second rotating levers 33*a* and 33*b*. The upper end sides of the first and second rotating levers 33*a* and 33*b* are rotatably attached to the attachment bracket 36 via pivotal shafts 35. The attachment bracket 36 is attached to the support carriage 15.

A spring member 37 spans between the lower portions of the first and second rotating levers 33*a* and 33*b*. Upon receiving the biasing force of the spring member 37, the first and second rotating levers 33*a* and 33*b* rotate about the pivotal shafts 35 so as to bring their lower portions close to each other. The guide rollers 32 move downward and project downward from a plane corresponding to the suction surfaces of the suckers 31 of the vacuum pads 10*a*.

In addition, the solenoid 38 is attached to the support carriage 15. When the solenoid 38 is excited, the lower portions of the first and second rotating levers 33*a* and 33*b* rotate about the about the pivotal shafts 35 so as to separate from each other against the biasing force of the spring member 37. The guide rollers 32 move upward and retreat from the plane corresponding to the suction surfaces of the suckers 31 of the vacuum pads 10*a*.

The operation of suppressing rising of the page Ta due to the inclination of the booklet T to close or open using the above-described guide rollers 32 will be described next with reference to FIGS. 20, 21, 22, and 23.

Figure 20:
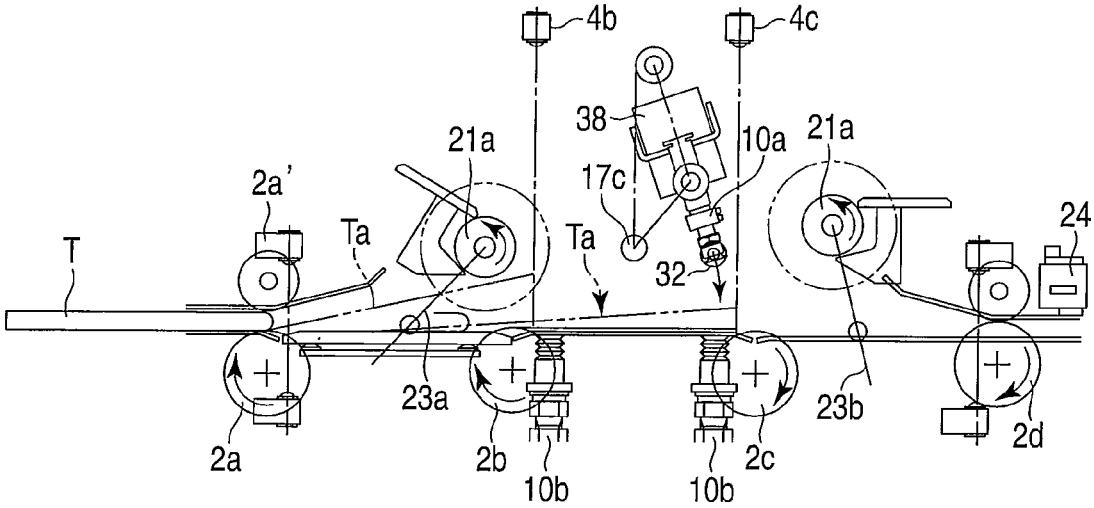
FIG. 20 is a view showing a case in which the page of the booklet is guided using the guide rollers in FIG. 16, and a state in which the guide rollers move down together with the vacuum pads.

FIG. 20 illustrates a state in which, for example, upon determining that the page number detected by the page number detection sensor 24 is not correct, the booklet T is returned to the upstream side of the page turning position 5 and then fed to the page turning position 5 again. Note that the booklet T is fed toward the page number detection sensor 24 with its binding portion set on the leading side.

When the booklet T is fed to the right side, as shown in FIG. 20, and the leading edge of the page Ta is detected by the detection sensor 4*b*, the left parallel link mechanism 23*a* at the retreat position rotates clockwise to move the pinch rollers 21*a* downward. The pinch rollers 21*a* that have moved downward and the feed roller 2*b* sandwich the booklet T and feed it to the page turning position 5. When the detection sensor 4*c* detects the leading edge of the page Ta of the fed booklet T, the vacuum pads 10*a* at the retreat position moved downward. In this downward movement, the guide rollers 32 move downward together with the vacuum pads 10*a*. At this time, the solenoid 38 is demagnetized so that the guide rollers 32 project downward from the suckers 31 of the vacuum pads 10*a* due to the spring force of the spring member 37. Hence, even when the page Ta of the fed booklet T is rising due to inclination to close, it comes into contact with the guide rollers 32 and are guided so that its rising upward is suppressed. That is, the guide rollers 32 function like a general guide plate.

Figure 21:
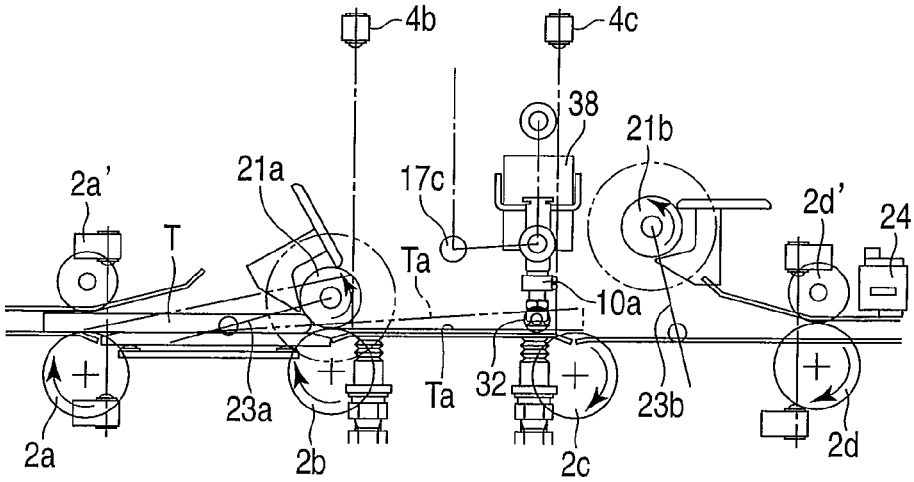
FIG. 21 is a view showing a state in which the page of the booklet in FIG. 20 is fed to the page turning position.
Figure 22:
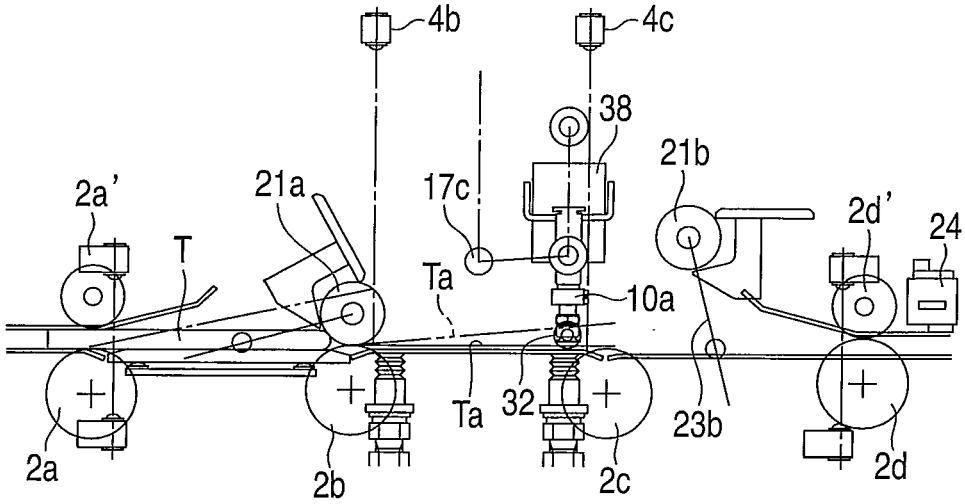
FIG. 22 is a view showing a state in which the page of the booklet in FIG. 21 is stopped at the page turning position and pushed down by the guide rollers.

After the detection sensor 4*c* detects the leading edge of the page Ta of the booklet T, the booklet T is fed by a predetermined distance up to the page turning position 5, as shown in FIG. 21, and stops, as shown in FIG. 22. At this time, the vacuum pads 10*a* are already positioned near the page Ta to be turned. If a page turning operation instruction is input, the solenoid 38 is excited, and the guide rollers 32 move upward and retreat from the positions of the suction surfaces of the suckers 31 of the vacuum pads 10*a* due to the spring force of the spring member 37. The suckers 31 of the vacuum pads 10*a* thus come into contact with the page Ta of the booklet T and start sucking the page Ta by negative pressure suction, thereby turning the page again.

After the page is turned again, the guide rollers 32 project downward from the suckers 31 of the vacuum pads 10*a* again, as described above, and come into contact with the page Ta of the booklet T, which is rising due to inclination to close, thereby regulating upward rising.

Figure 23:
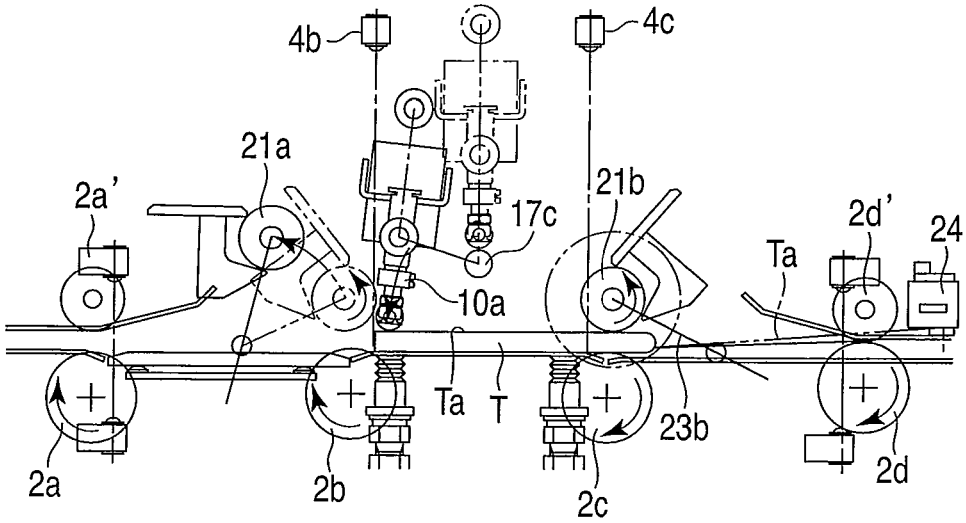
FIG. 23 is a view showing a state in which the booklet is transferred and fed from the state in FIG. 22.

After that, the vacuum pads 10*a* retreat, as shown in FIG. 23, and the right parallel link mechanism 23*b* rotates counterclockwise to move the pinch rollers 21*b* downward. The booklet T is sandwiched between the pinch rollers 21*b* and the feed roller 2*c* and fed. The page Ta is fed below the page number detection sensor 24 to read the page number.

Note that when the vacuum pads 10*a* move downward, and the guide rollers 32 project downward from the suckers 31, as shown in FIG. 20, the page Ta rising due to the inclination of the booklet T to close comes into contact with the guide rollers 32 from a direction shifted from the normal direction of the vacuum pads 10*a*, as shown in FIG. 17. At this time, since the guide rollers 32 always come into contact with the page Ta earlier than the suckers 31 of the vacuum pads 10*a*, the suckers of the vacuum pads never curl up, unlike the prior art.

As described above, according to this embodiment, the guide rollers 32 are attached to the support carriage 15 of the vacuum pads 10*a*, and moved together with the vacuum pads 10*a*. This allows a page turning operation without needing a complex mechanism for making the feed guides retreat during the page turning operation, unlike the prior art.

The guide rollers 32 are provided to freely project/retreat from a plane corresponding to the suction surfaces of the vacuum pads 10*a*, and made to project downward from the suction surfaces of the vacuum pads 10*a* when they move downward. This allows the guide rollers 32 to come into contact with the page of a booklet, which is rising due to inclination to close (or inclination to open) earlier than the suckers 31, and guide the page.

It is therefore possible to move the vacuum pads 10*a* downward and cause the guide rollers 32 to regulate rising of the page Ta of the booklet T without waiting for the time until the booklet T reaches the page turning position 5 and stops, and thus shorten the process time.

The page Ta rising due to inclination to close (or inclination to open) does not come into contact with the suckers 31 of the vacuum pads 10*a*. This makes it possible to prevent the suckers 31 from curling up without using an umbrella-shaped member, and thus facilitate maintenance works such as cleaning and exchange.

Note that in the above embodiment, the solenoid 38 operates the rotating levers 33*a* and 33*b* to vertically move the guide rollers 32. However, the present invention is not limited to this. For example, the guide rollers 32 may be moved vertically using a motor and a cam mechanism.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A booklet page turning apparatus comprising:

a feed device which feeds a booklet to a page turning position;

a vacuum pad which comes into contact with an uppermost page of the booklet fed to the page turning position by the feed device and vacuum-chucks the page;

a driving device which moves the vacuum pad so as to lift the uppermost page of the booklet by a predetermined angle in a direction of opening the page about a binding portion;

a contact roller unit which enters under the uppermost page lifted by the predetermined angle;

a control device which controls to, after the contact roller unit has entered under the uppermost page, cancel vacuum chuck of the vacuum pad to make the vacuum pad retreat from the uppermost page to a retreat position, and feed the booklet so as to bring the uppermost page into contact with the contact roller unit and open the page; and a guide member provided near the vacuum pad to freely project/retreat from a plane corresponding to a suction surface of the vacuum pad, the guide member moving integrally with the vacuum pad and coming into contact with a page of the booklet at the page turning position to regulate rising of the page.

2. The apparatus according to claim 1, wherein the guide member comprises a guide roller.

3. The apparatus according to claim 2, wherein the guide roller is attached to a link mechanism, and projects/retreats from the plane corresponding to the suction surface of the vacuum pad as the link mechanism rotates.

4. The apparatus according to claim 3, wherein the link mechanism is driven by a solenoid.

5. The apparatus according to claim 1, wherein the booklet fed to the page turning position to turn the page is fed to a page number detection device provided downstream in a feed direction so that a page number is detected.

6. The apparatus according to claim 1, wherein a pump is connected to the vacuum pad via a negative pressure supply circuit.

7. The apparatus according to claim 1, further comprising a lower vacuum pad which comes into contact with a lower surface of the booklet to vacuum-chuck the lower surface.

8. A booklet page turning method comprising:

feeding a booklet to a page turning position;

bringing a vacuum pad into contact with an uppermost page of the booklet fed to the page turning position to vacuum-chuck the page;

moving the vacuum pad so as to lift the uppermost page of the booklet by a predetermined angle in a direction of opening the page about a binding portion;

causing a contact roller unit to enter under the uppermost page lifted by the predetermined angle;

after the contact roller unit has entered under the uppermost page, canceling vacuum chuck of the vacuum pad to make the vacuum pad retreat from the uppermost page to a retreat position, and feeding the booklet so as to bring the uppermost page into contact with the contact roller unit and opening the page; and moving a guide member provided near the vacuum pad to freely project/retreat from a plane corresponding to a suction surface of the vacuum pad integrally with the vacuum pad so as to bring the guide member into contact with a page of the booklet at the page turning position and regulate rising of the page.

9. The method according to claim 8, wherein the guide member comprises a guide roller.

10. The method according to claim 9, wherein the guide roller is attached to a link mechanism, and projects/retreats from the plane corresponding to the suction surface of the vacuum pad as the link mechanism rotates.

11. The method according to claim 10, wherein the link mechanism is driven by a solenoid.

12. The method according to claim 8, wherein the booklet fed to the page turning position to turn the page is fed to a page number detection device provided downstream in a feed direction so that a page number is detected.

13. The method according to claim 8, wherein a negative pressure is supplied to the vacuum pad via a negative pressure supply circuit.

14. The method according to claim 8, wherein a lower vacuum pad is brought into contact with a lower surface of the booklet to vacuum-chuck the lower surface.

15. A booklet processing apparatus comprising:

a storage unit which stores a booklet;

a supply device which supplies the booklet stored in the storage unit;

a feed device which feeds the booklet supplied by the supply device to a page turning position;

a vacuum pad which comes into contact with an uppermost page of the booklet fed to the page turning position by the feed device and vacuum-chucks the page;

a driving device which moves the vacuum pad so as to lift the uppermost page of the booklet by a predetermined angle in a direction of opening the page about a binding portion;

a contact roller unit which enters under the uppermost page lifted by the predetermined angle;

a control device which controls to, after the contact roller unit has entered under the uppermost page, cancel vacuum chuck of the vacuum pad to make the vacuum pad retreat from the uppermost page to a retreat position, and feed the booklet so as to bring the uppermost page into contact with the contact roller unit and open the page;

a guide member provided near the vacuum pad to freely project/retreat from a plane corresponding to a suction surface of the vacuum pad, the guide member moving integrally with the vacuum pad and coming into contact with a page of the booklet at the page turning position to regulate rising of the page; and a printing device which prints information on the opened page of the booklet.

16. The apparatus according to claim 15, wherein the guide member comprises a guide roller.

17. The apparatus according to claim 16, wherein the guide roller is attached to a link mechanism, and projects/retreats from the plane corresponding to the suction surface of the vacuum pad as the link mechanism rotates.

18. The apparatus according to claim 17, wherein the link mechanism is driven by a solenoid.

19. The apparatus according to claim 15, wherein the booklet fed to the page turning position to turn the page is fed to a page number detection device provided downstream in a feed direction so that a page number is detected.

20. The apparatus according to claim 15, wherein a pump is connected to the vacuum pad via a negative pressure supply circuit.

* * * * *